US005902373A

United States Patent [19]

Vännman et al.

[11] Patent Number: 5,902,373

[45] **Date of Patent: *May 11, 1999**

[54] SPONGE-IRON POWDER

[75] Inventors: Erik Vännman, Helsingborg; Lars-Åke Larsson, Höganäs, both of Sweden; Michael Ostgathe, Weinheim; Fritz Thümmler, Karlsruhe, both of Germany

[73] Assignee: Hoganas AB, Hoganas, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/505,173

[22] PCT Filed: Feb. 2, 1994

[86] PCT No.: PCT/SE94/00076

§ 371 Date: Aug. 29, 1995

§ 102(e) Date: Aug. 29, 1995

[87] PCT Pub. No.: WO94/17939

PCT Pub. Date: Aug. 18, 1994

[30] Foreign Application Priority Data

Feb. 11, 1993 [SE] Sweden ..... 9300457

[51] Int. Cl.[6] ..... B22F 9/04

[52] U.S. Cl. ..... 75/352; 75/354; 241/24.13; 241/24.25

[58] Field of Search ..... 75/252, 351, 352, 75/354; 241/24.13, 24.25

[56] References Cited

U.S. PATENT DOCUMENTS

| | | | |
|---|---|---|---|
| 3,591,362 | 7/1971 | Benjamin | 75/354 |
| 4,217,151 | 8/1980 | Mizuno et al. | 75/352 |
| 4,518,427 | 5/1985 | Tengzelius et al. | 75/255 |
| 4,647,304 | 3/1987 | Petrovic-Loton et al. | 75/354 |
| 4,787,561 | 11/1988 | Kemp et al. | 75/354 |

FOREIGN PATENT DOCUMENTS

| | | |
|---|---|---|
| 0 079 320 | 5/1983 | European Pat. Off. . |
| 1 045 436 | 12/1958 | Germany . |
| 1 905 764 | 9/1969 | Germany . |
| WO 92/21783 | 12/1992 | WIPO . |

OTHER PUBLICATIONS

"Sintered Steels With High Content of Hard Phases: A New Class of Wear Resistant Materials", F. Thümmler et al., *Powder Metallurgy International*, vol. 23, No. 5, 1991, pp. 285–290.

*Primary Examiner*—George Wyszomierski
*Attorney, Agent, or Firm*—Woodcock Washburn Kurtz, Mackiewicz & Norris LLP

[57] ABSTRACT

The invention relates to a composition and a method for producing a finely ground powder of sponge-iron and hard-phase material.

8 Claims, 4 Drawing Sheets

SPONGE-IRON POWDER

The present invention relates to iron-based powder compositions containing hard-phase material. More specifically, the invention relates to powder compositions based on sponge iron.

According to the invention, a finely divided powder material is prepared which can be used for making compacted and sintered products. The desired properties of the finished product are determined e.g. by the hard-phase materials selected. The properties of the sintered product can also be affected by alloying additivies which may be included in the powder composition of the invention.

Iron-based powder materials containing hard-phase material are described e.g. in an article by Thümmler et al (Powder Metallurgy International, Vol. 23, No. 5, 1991, pp 285–290). For making such iron-based materials, the iron-containing starting material used has been atomised iron powder or carbonyl iron which when ground with hard-phase material is stated to provide a mechanically alloyed powder that can be used for making sintered products having high abrasion resistance.

It has now been found that if atomised iron or carbonyl iron is replaced by sponge iron as starting material in grinding together with hard-phase materials, it is possible to produce a powder of potentially equally useful properties as the known powder. Apart from the advantage of sponge iron being essentially cheaper than atomised iron and carbonyl iron, the powder composition of the present invention can be produced by significantly less energy-intensive and less complicated grinding procedures than when producing the above-mentioned known powder compositions.

In the method of the present invention, sponge-iron powder, powder of hard-phase material and optionally alloying substances are mixed in a milling device, such as a ball mill containing balls of steel or ceramic material. The mill vessel, containing powder and balls, is filled with liquid, such as heptane, alchol, cyclohexane or water, and a dispersing agent is also optionally added to the liquid, whereupon the vessel is sealed after it has been filled with nitrogen gas or any other inert gas. The mill vessel is thereafter rotated as long as the desired particle size and particle size distribution is obtained. Examples of other types of milling devices are attrition mills or vibratory mills.

Grinding methods of the type used according to the present invention are described in German Patent Publication 1,905,764. However, this publication is concerned with the grinding of only a metal, without the addition of hard-phase material, thus yielding a type of particles having a powder density of less than 1 g/cm$^3$ and a surface area of at least 1 m$^2$/g. In the conception of the present invention, it has however been found that if these particles are mixed with particles of hard-phase material, a powder of inadequate compressibility is obtained. If, on the other hand, grinding of sponge-iron powder takes place in the presence of hard-phase powder, a fine powder is obtained which, optionally after conventional agglomeration, is well suited for the production of compacted and sintered products, which are expected to have desirable properties because of the presence of hard-phase material. Also in respect of the sintering process itself, the new powders are expected to yield valuable advantages as compared with conventional powder compositions.

The sponge-iron powder used as starting material suitably is a commercially available, annealed or non-annealed sponge-iron powder, such as NC 100.24 or M 100 having an average particle size of 90 $\mu$m. These powders are commercially available from Höganäs AB. The invention is however not restricted to powders having such average particle sizes but also larger and smaller sizes can be used.

The degree of grinding varies depending on the type and the particle size of the starting materials, and is suitably determined in each particular case. When using e.g. NC 100.24 or M 100 having an average particle size of about 90 $\mu$m, favourable results have been obtained when grinding to an average particle size of about 60 $\mu$m, preferably 50 $\mu$m. Generally, small particle sizes are advantageous in terms of sintering, but less advantageous in terms of compressibility. In certain cases, agglomeration of the powder obtained in grinding may be desirable in order to achieve satisfactory compressibility characteristics.

The hard-phase material can be selected from commercial hard-phase materials such as NbC, TiN, TiC, $Al_2O_3$, SiC, $Cr_3C_2$, VC, $Mo_2C$, WC, the amount of hard-phase material in the ground composition amounting to at most about 80% by volume.

According to the invention, pulverulent alloying additives can also be admixed in the powder composition, either before or after the grinding process. Examples of alloying additives are Ni, Mo, Mn, Cr, Cu, Si, V, Ti, P, $Fe_3P$ and C.

DETAILED DESCRIPTION OF THE PREFERRED EMBODIMENTS

The invention will be illustrated in more detail in the following Example, which is by no means intended to restrict the scope of the invention.

Example

To a ball mill having a diameter of 210 mm and a length of 250 mm were charged steel balls (12000 g, diameter 4 mm) as well as 1200 g of a powder mixture containing iron powder, hard-phase powder and optionally alloying elements in powder form. The mill was filled with 2000 g of n-heptane and nitrogen gas. Then, the mill was sealed and rotated at a speed of 59 rpm. The following powder mixtures were ground:

*NC*100.24+5.4% $Al_2O_3$ (10% by volume of $Al_2O_3$)

*ASC*100.29+5.4% $Al_2O_3$ (10% by volume of $Al_2O_3$)

*NC*100.24+9.7% NbC (10% by volume of NbC)

*ASC*100.29+9.7% NbC (10% by volume of NbC)

*NC*100.24+20% INCO123 (Ni)+5% $Al_2O_3$

*ASC*100.29+20% INCO123 (Ni)+5% $Al_2O_3$

*NC*100.24+20% INCO123 (Ni)+5% $Al_2O_3$ +3.75% $Fe_3P$

*ASC*100.29+20% INCO123 (Ni)+5% $Al_2O_3$ +3.75% $Fe_3P$

The powder, designated NC100.24, is a sponge-iron powder commercially available from Höganäs AB and having an average particle size of 105 $\mu$m.

The powder ASC100.29 is an atomised iron powder from Höganäs AB having an average particle size of 105 $\mu$m.

$Al_2O_3$ and NbC are added as hard-phase material having an average particle size of less than 5 $\mu$m. $Fe_3P$ having an average particle size of less than 5 μm is added as alloying element, like nickel, INCO123, having an average particle size of 8 μm.

Figure 1:
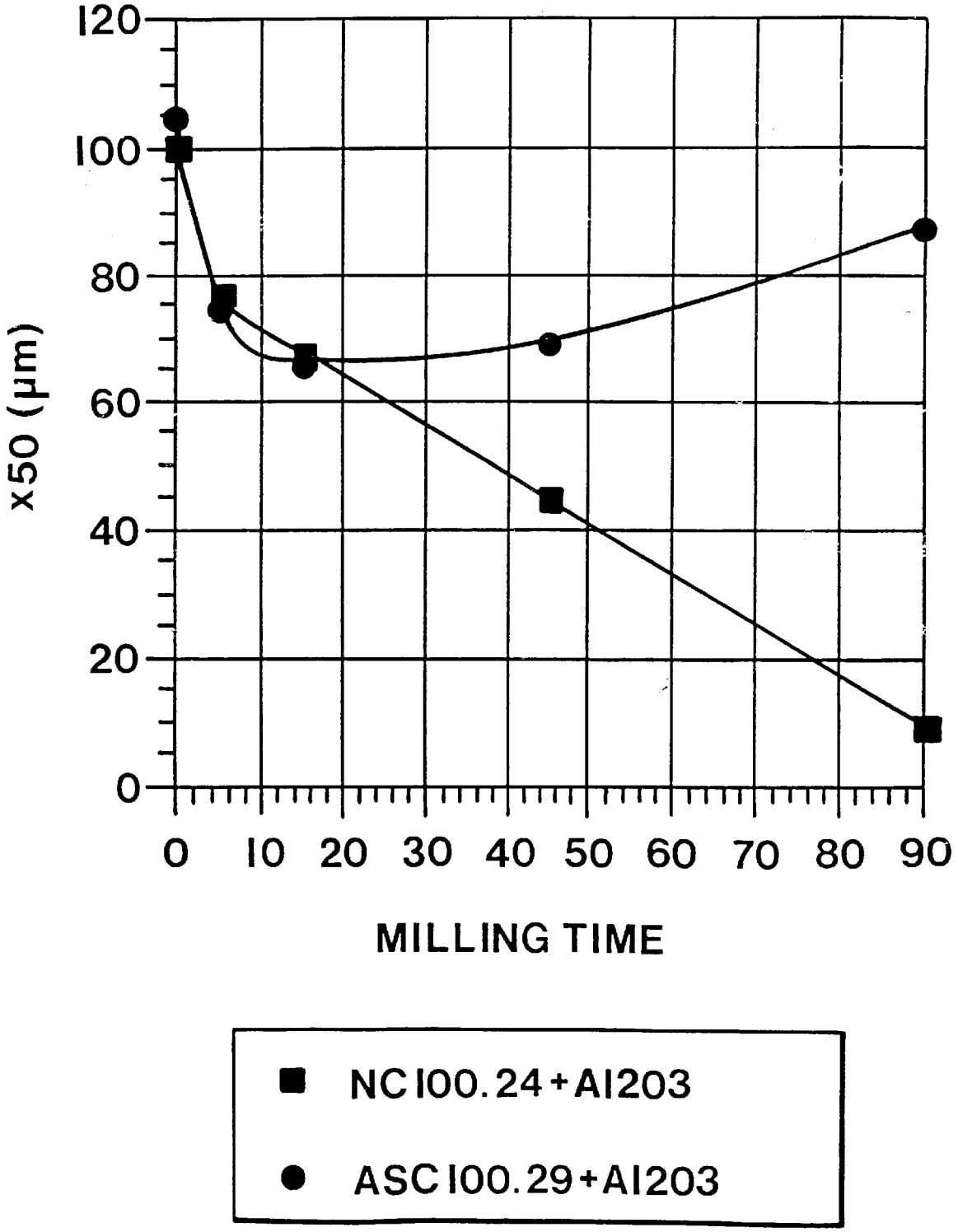
FIGS. 1, 2, 3, and 4 show the relationship between milling time and particle size of several examples of the present invention in comparison to the prior art.
Figure 2:
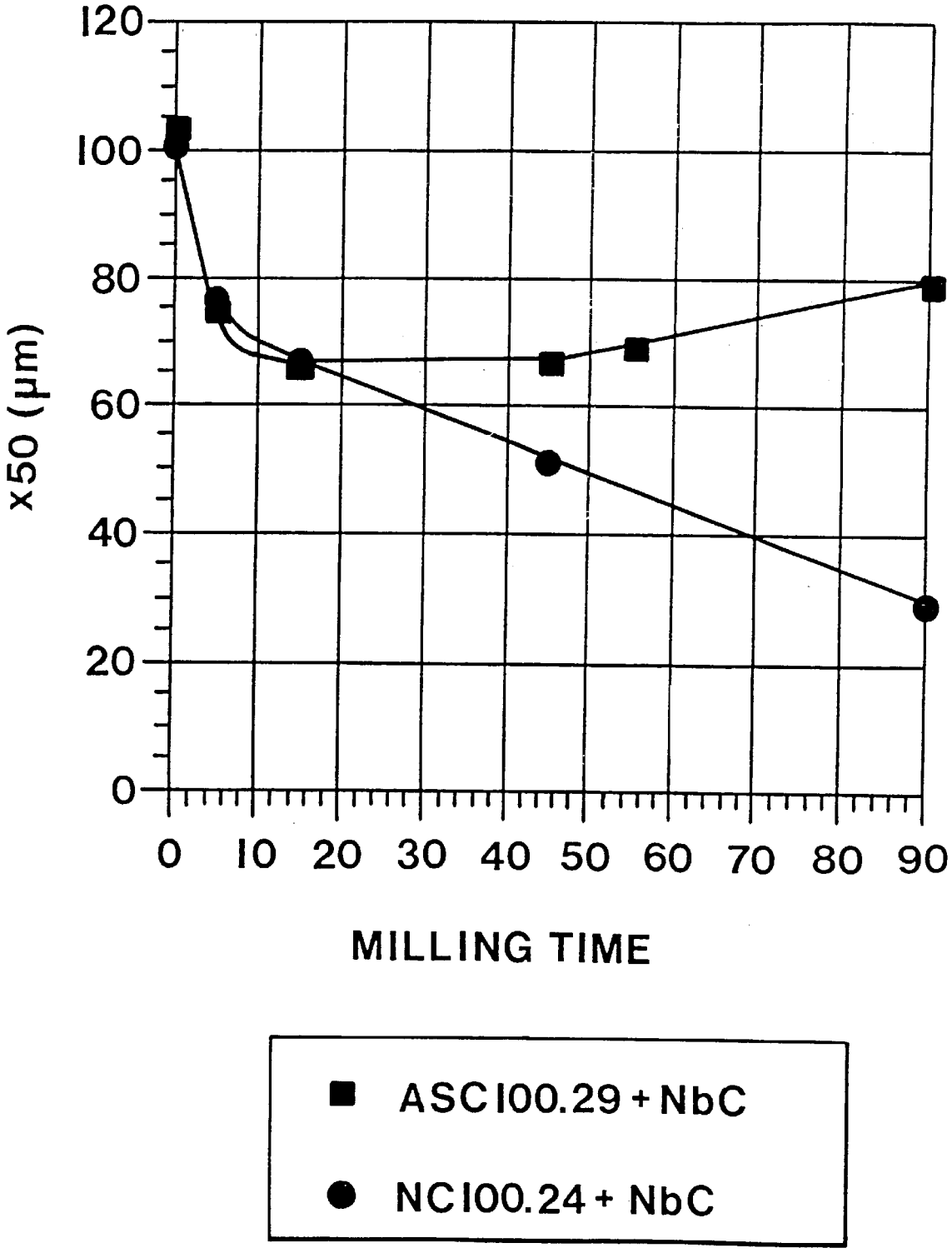
Figure 3:
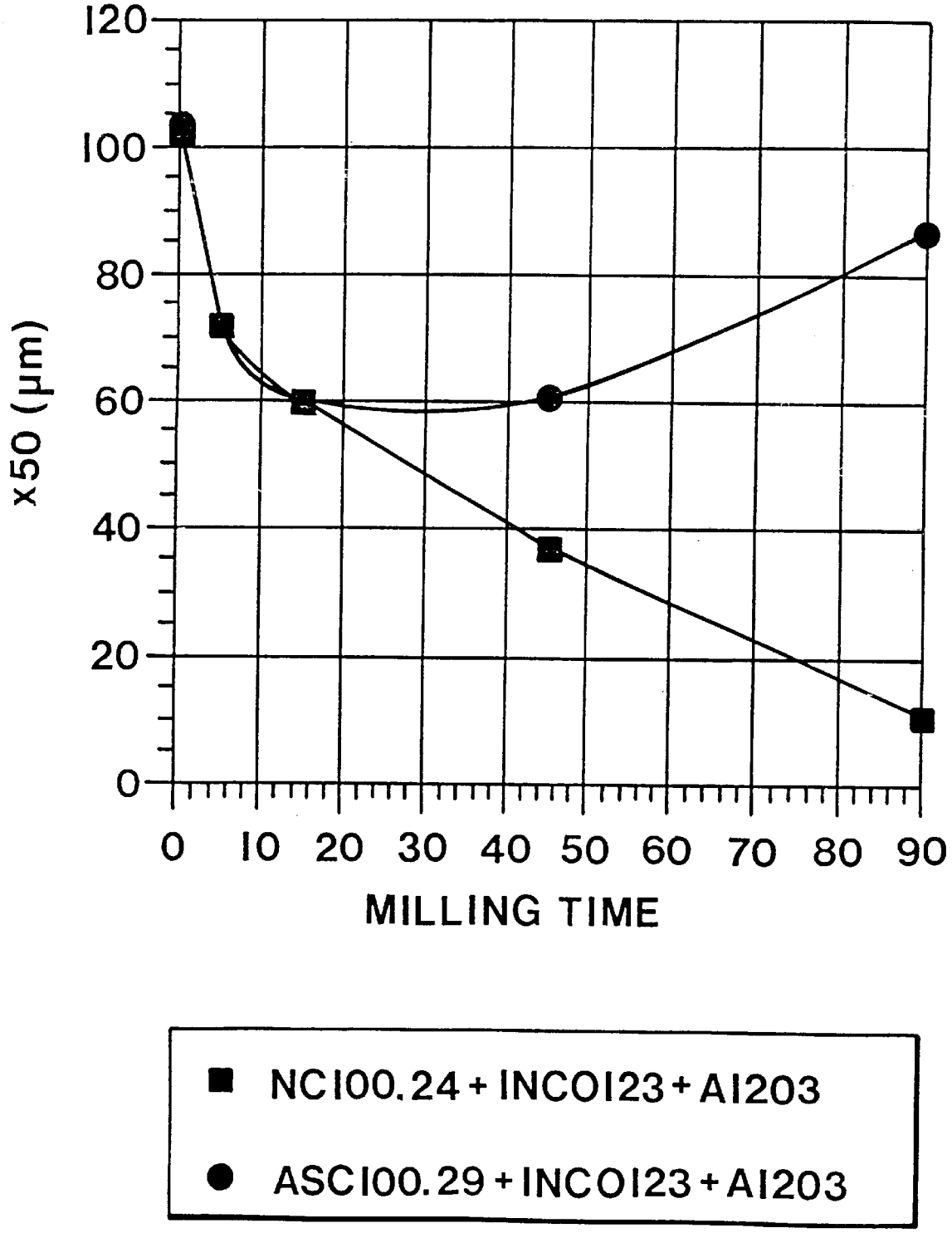
Figure 4:
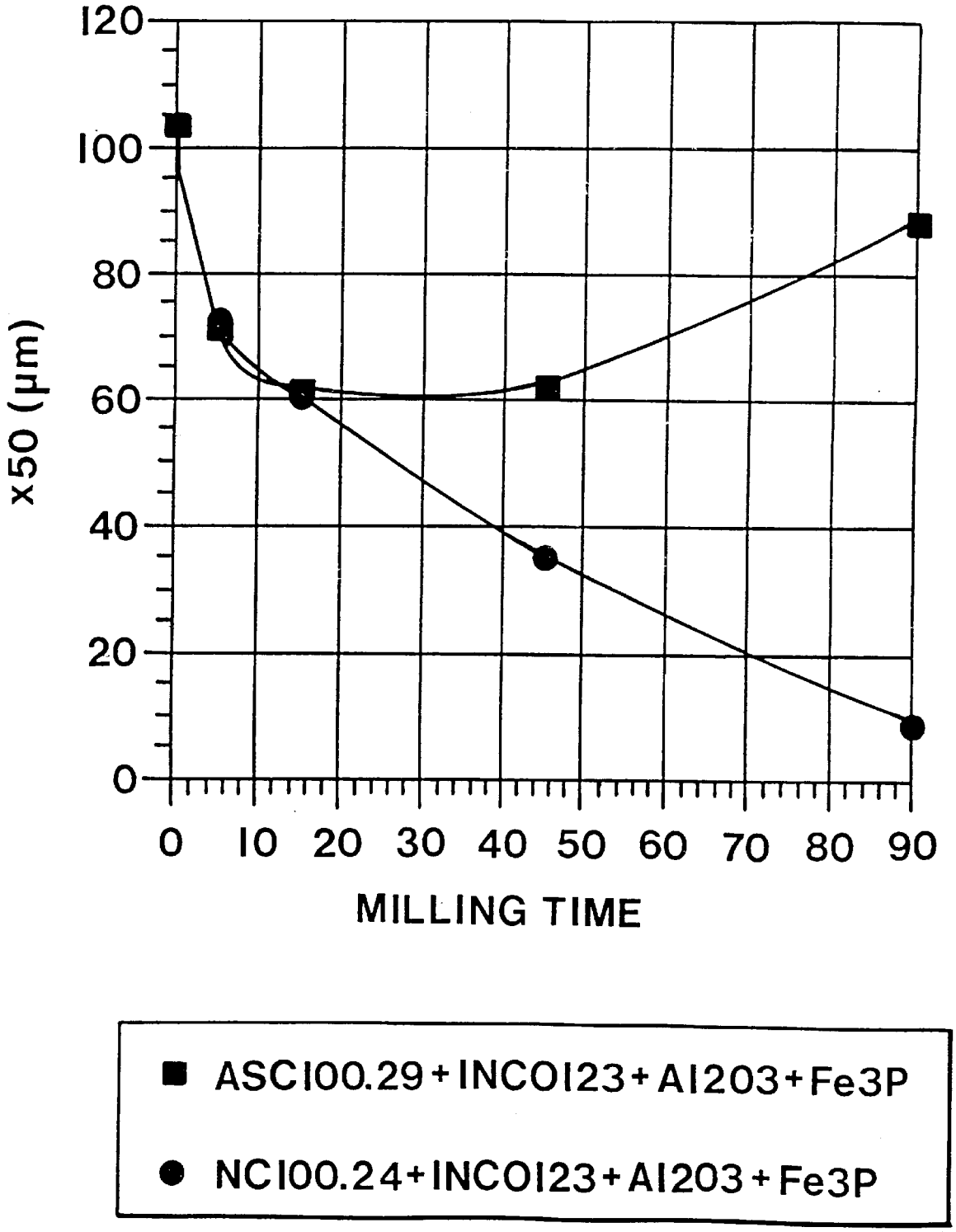

From FIGS. 1–4 clearly appears that the atomished powder ASC100.29, when blended during grinding with hard-phase material, permits grinding only to a limited extent, and that an increased grinding time does not lead to any corresponding decreased particle size, which is the case if sponge-iron powder NC100.24 according to the invention is used.

We claim:

1. A method for producing a composition of a blended and ground powder containing sponge iron and hard-phase material selected from the group consisting of NbC, TiN, TiC, $Al_2O_3$, SiC, $Cr_3C_2$, VC, $Mo_2C$, WC and/or combinations thereof, comprising blending sponge-iron powder and a powder of said hard phase material and optional alloying additives in an inert atmosphere in a milling device containing liquid that is in its liquid state at ambient conditions selected from the group consisting of heptane, alchol, cyclohexane or water or mixtures thereof, grinding the mixture until the desired particle size and particle size distribution have been obtained to form a milled powder, the milled powder having an average particle size of less than 50 μm, and thereafter separating and drying the milled powder.

2. A method as claimed in claim 1, wherein the grinding is performed in a ball mill in a gaseous nitrogen atmosphere.

3. A method as claimed in claim 1, wherein during the grinding the particle size of the sponge-iron is reduced at least 50%.

4. A method for producing a milled powder metallurgy composition, the steps consisting essentially of:

(a) charging a powder composition consisting essentially of (I) a major amount of sponge iron powder;

(ii) a minor amount of a hard-phase material selected from the group consisting of NbC, TiN, TiC, $Al_2O_3$, SiC, $Cr_3C_2$, VC, $Mo_2C$, WC and combinations thereof;

(iii) and optionally a minor amount of alloying powder, into a milling device;

(b) milling the powder composition in an inert atmosphere within the milling device in the presence of a liquid that is in its liquid state at ambient conditions selected from the group consisting of heptane, alcohol, cyclohexane, water, and mixtures thereof until the milled powder composition has an average particle size of less than 50 μm; and (c) recovering the milled powder composition from the milling device and drying the milled powder composition.

5. A method for producing a milled powder metallurgy composition, the steps comprising:

(a) charging a powder composition consisting essentially of (I) sponge iron powder;

(ii) hard-phase material selected from the group consisting of NbC, TiN, TiC, $Al_2O_3$, SiC, $Cr_3C_2$, VC, $Mo_2C$, WC and combinations thereof in an amount of up to 80% by volume;

(iii) and optionally a minor amount of alloying powder, into a milling device;

(b) milling the powder composition in an inert atmosphere within the milling device in the presence of a milling liquid that is in its liquid state at ambient conditions until the milled powder composition has an average particle size of less than 50 μm; and (c) recovering the milled powder composition from the milling device and drying the milled powder composition.

6. A method as claimed in claim 5, wherein the milling is performed in a ball mill in a gaseous nitrogen atmosphere.

7. The method of claim 5 wherein the powder composition comprises an alloying powder selected from the group consisting of Ni, Mo, Mn, Cr, Cu, Si, V, Ti, P, $Fe_3P$, C, and mixtures thereof.

8. The method of claim 5, wherein during the milling step the particle size of the sponge-iron is reduced at least 50 %.

* * * * *